US006170222B1

(12) United States Patent
Miller

(10) Patent No.: US 6,170,222 B1
(45) **Date of Patent: *Jan. 9, 2001**

(54) APPARATUS FOR USE ON PITCHED ROOFS AND RELATED METHOD

(75) Inventor: James Miller, Upper Darby, PA (US)

(73) Assignee: Malco Products, Inc., Annandale, MN (US)

( * ) Notice: Under 35 U.S.C. 154(b), the term of this patent shall be extended for 0 days.

This patent is subject to a terminal disclaimer.

(21) Appl. No.: 09/366,116

(22) Filed: Aug. 2, 1999

Related U.S. Application Data

(63) Continuation of application No. 09/244,719, filed on Feb. 4, 1999, which is a continuation-in-part of application No. 09/094,164, filed on Jun. 9, 1998, now Pat. No. 5,943,839.

(60) Provisional application No. 60/053,249, filed on Jul. 21, 1997.

(51) Int. Cl.[7] ..... E04B 7/18

(52) U.S. Cl. ..... 52/749.12; 52/748.1; 52/DIG. 1; 248/237; 248/346.01

(58) Field of Search ..... 52/748.1, 749.12, 52/DIG. 1; 182/45; 248/148, 237, 146, 346.01, 618

(56) References Cited

U.S. PATENT DOCUMENTS

| | | | | |
|---|---|---|---|---|
| D. 398,820 | * | 9/1998 | Cougar | D8/14 |
| 1,707,574 | | 4/1929 | Rothmann . | |
| 2,659,418 | * | 11/1953 | Berman | 155/179 |
| 3,648,308 | | 3/1972 | Greenawalt . | |
| 4,043,093 | * | 8/1977 | Riggs | 52/749 |
| 4,043,424 | * | 8/1977 | Crain | 182/230 |
| 4,092,751 | * | 6/1978 | Burkholder et al. | 5/345 R |
| 4,193,150 | | 3/1980 | Vineberg . | |
| 4,423,694 | * | 1/1984 | Senneville | 112/405 |
| 4,789,046 | * | 12/1988 | McDowall | 182/230 |
| 4,955,096 | * | 9/1990 | Gilroy et al. | 5/464 |
| 4,987,720 | * | 1/1991 | Wozney, Jr. | 52/749 |
| 5,249,397 | * | 10/1993 | Monaco | 52/126.1 |
| 5,546,671 | | 8/1996 | Kehoe . | |
| 5,887,406 | * | 3/1999 | Bond | 52/749.12 |
| 5,943,839 | * | 8/1999 | Miller | 52/748.1 |

OTHER PUBLICATIONS

Bethlehem Steel Company publication, p. 10, first row, fourth bar from left of page, copyright 1937.

* cited by examiner

*Primary Examiner*—Carl D. Friedman
*Assistant Examiner*—Phi Dieu Tran A
(74) *Attorney, Agent, or Firm*—Gerald E. Helget; Rider, Bennett, Egan & Arundel

(57) ABSTRACT

An apparatus which is useful on pitched roofs includes structural features which help keep roofing materials from sliding off the roof. The apparatus also protects roofers from heat and abrasion from the roof surface on which they are working. A substantially solid foam rubber wedge forms one component of the apparatus, and a substantially planar pad forms the other component of the apparatus. These components are placed in proximity to each other so that the roofer, when situated on the pad, can readily reach roofing materials disposed against the wedge. The wedge resiliently compresses when roofing materials are placed on its upper surface. This resilient compression, the angle of orientation of the wedge's upper surface, and the frictional engagement of the wedge with the roof surface each contribute in varying degrees to holding roofing materials in position on the roof. The pad is made of material which reduces the amount of heat passing from the roofing surface to the upper surface of the pad on which the roofer is situated.

1 Claim, 5 Drawing Sheets

APPARATUS FOR USE ON PITCHED ROOFS AND RELATED METHOD

FIELD OF THE INVENTION

This application is a continuation to U.S. application Ser. No. 09/244,719, filed Feb. 4, 1999 which is a continuation-in-part to U.S. application Ser. No. 09/094,164 filed Jun. 9, 1998, now U.S. Pat. No. 5,943,839 which claimed the benefit of U.S. Provisional Application No. 60/053,249 which was filed Jul. 21, 1997.

This invention relates to an apparatus for applying roofing material on roofs and in particular to apparatus for assisting roofers in applying roofing material to pitched roofs and a related method.

BACKGROUND OF THE INVENTION

Installing or repairing a shingled roof is generally a labor-intensive process. Numerous courses of shingles generally need to be installed across all or a portion of the surface area of the roof, and such installation needs to be accomplished according to sound and established roofing methods, with the courses laid on the surface area in the appropriate sequential order.

In addition, the environment and conditions in which roofers must install such roofs are often difficult. For example, the roofer must constantly adapt his or her efforts to take account of the pitch of the roof surface on which he or she is working. Movement of the roofer may also be constrained by safety equipment used during the roofing process. On relatively warm days, the roofing surface it self becomes hot not only to kneel on, but also to come in contact with. Furthermore, the outer surfaces of shingles tend to be coarse and thus abrade the roofer's skin in the course of performing roofing activities, unless suitable precautions are taken by the roofer.

Roofing activities often also present logistical challenges. In particular, packages of shingles and other roofing materials need to be transported to the roofing surface and made readily accessible to the roofers in an efficient manner, so work can likewise be performed efficiently. The pitch of the roof complicates the delivery and storage of roofing materials in close proximity to the roofer. Stacks of shingles or other planar roofing materials cannot merely be placed on a pitched roofing surface because they are prone to slide off the roof onto the ground below. Such falling materials, at a minimum, would cause a delay in the project as the materials are retrieved. In addition, such mishaps may damage the roofing materials themselves, as well as objects or persons struck by the falling materials.

Prior art attempts to solve some of these problems have had mixed results. For example, in order to create suitable storage areas for shingles and other planar roofing materials on the roof, roofers generally nail together boards on an ad hoc basis to create a shelf-like structure. Such shelf-like structure is generally nailed into the roof surface itself in order to hold it in position, and the shelf-like structure may include a vertically extending lip on the downward edge of the shelf structure to keep the roofing materials from sliding. Alternately, the shelf may be provided with a vertical "leg" which counteracts the pitch of the roof and creates a more horizontal surface on the shelf-like structure to hold the shingles in place.

The above-outlined approach suffers from various disadvantages, chief among them being the need to affix the shelf-like structure by nailing it into the very roof which is being installed or repaired. The apertures formed in the roof and other damages potentially caused by attaching such an ad hoc structure are obviously undesirable. In addition, as the roofers are required to move to different areas on the surface of the roof, they must either walk to the shelf-like structure attached to the roof, or remove it and reattach it at a more convenient location, again by nailing it into position. The roofer is thus required to undergo the inconvenience and risk of repeatedly crawling or walking back and forth between his or her work site and the area where the materials are stored, or the roofer must take the time to repeatedly remove and reattach the ad hoc shelf-like structure.

Another attempt at solving the above-outlined challenges associated with roofing involves products known as the Shingle Board and the Kneeling Board, currently manufactured by Cougar Paws, Inc., of Woodbridge, Va. These solutions suffer from their own drawbacks and disadvantages. For example, both of these items are relatively large, heavy and complex structures making them relatively expensive to manufacture and purchase, and relatively unwieldy to hoist to the roofing surface itself and move about thereafter.

Accordingly, there is a need for an apparatus which is relatively lightweight so that it can be readily hoisted to the roof surface and moved about on such a surface thereafter.

There is a need for such apparatus to protect the roofer from heat and abrasion of his knees and other body parts which come regularly into contact with the roof during the installation process. There is a further need for such apparatus to keep bundles of shingles and other planar roofing materials from sliding off the roof, and there is an associated need for such device to be easily moved from one location to another on the roofing surface.

There is still further need for an apparatus which can be used without damaging the surface of the shingles and without otherwise compromising the integrity of the roof.

SUMMARY OF THE INVENTION

The apparatus, according to the present invention, includes a wedge of resiliently compressible material. The wedge has a bottom surface which can be placed against the roof and an upper surface which is inclined relative to the bottom surface. The inclination of the upper surface at least partially counteracts the pitch of the roof when the forward edge of the roof is facing toward the peak of the pitched roof. In this way, the upper surface of the wedge is more horizontal than the surface of the roof. The bottom surface of the wedge is structured or finished so that there is friction between the wedge and the roof surface on which the wedge is situated. When roofing materials are placed on the upper surface of the wedge, the upper surface resiliently compresses, and thereby forms a retaining dam against which the roofing materials are disposed. Since the resiliently compressible material of the wedge has a plastic memory, a force is generated in the direction of the peak of the roof corresponding to the weight of the roofing materials disposed on the upper surface of the wedge.

According to another aspect of the invention, the apparatus also includes a substantially flat member which defines a pad on which the roofer is situated while on the roof. The pad has a lower planar surface for placement against the roof, and an opposite surface on which the roofer is situated. Material between the foregoing, two surfaces provides some insulation to the roofer from heat which may be generated by the roof surface against which the pad has been placed. The lower surface of the pad is sufficiently pliant to avoid damaging the finish of the shingles with which the lower surface is in contact.

BRIEF DESCRIPTION OF THE DRAWINGS

The following is a description of the several views of the drawings, FIGS. 1 through 9.

DETAILED DESCRIPTION OF THE PREFERRED EMBODIMENT

The following detailed description is of the best presently contemplated mode of carrying out the invention. The description is not intended in a limiting sense, and is made solely for the purpose of illustrating the general principles of the invention. The various features and advantages of the present invention are more readily understood with reference to the following detailed description taken in conjunction with the accompanying drawings.

Figure 5:
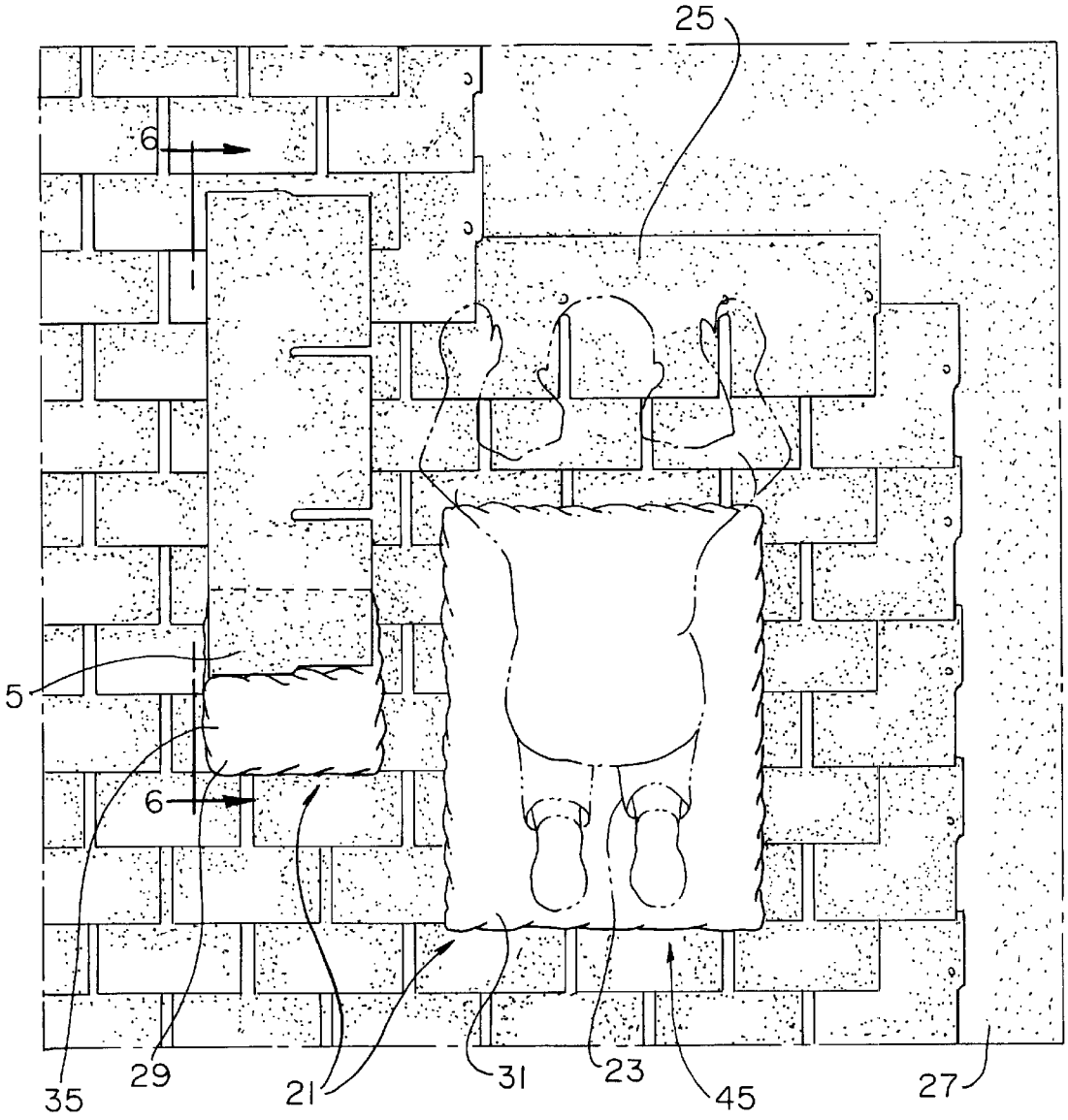
FIG. 5 is a fragmentary top plan view of an apparatus according to the present invention, showing the apparatus used in the process of applying roofing material to a roof surface.

Referring to the drawings in detail and in particular to FIG. 5 thereof, there is shown an apparatus 21 for assisting a roofer 23 during application of roofing material, in this case shingles 25, to a pitched roof 27. Referring now more generally to all of the Figures, apparatus 21 preferably includes two main components, a wedge 29 of resiliently compressible material and a substantially flat member 31 defining a pad on which the roofer can sit, kneel or otherwise situate him- or herself.

Wedge 29, as detailed below, includes structural features which keep a stack of shingles 25 from falling off pitched roof 27 when the stack of shingles 25 is placed on wedge 29. The pad 31, as detailed below, includes features which protect roofer 23 from heat and abrasion from pitched roof 27, and which protect the underlying shingles 25 from inadvertent damage by the roofer while he or she is working on pitched roof 27.

Figure 1:
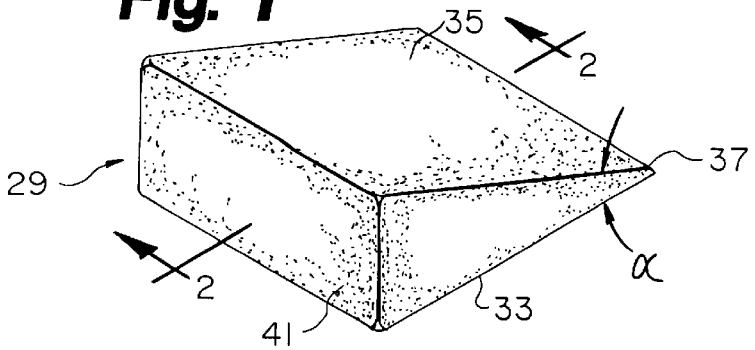
FIG. 1 is an isometric view showing a wedge-shaped solid of foam rubber, according to the invention, to create a high-friction retaining dam for a package of roofing shingles resting on a sloped roof.
Figure 2:
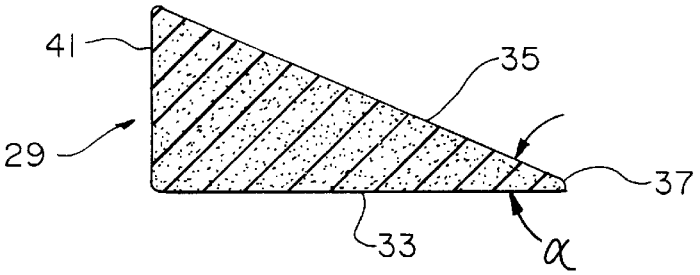
FIG. 2 is a slightly enlarged sectional elevational view taken on the line 2,2 of FIG. 1.
Figure 6:
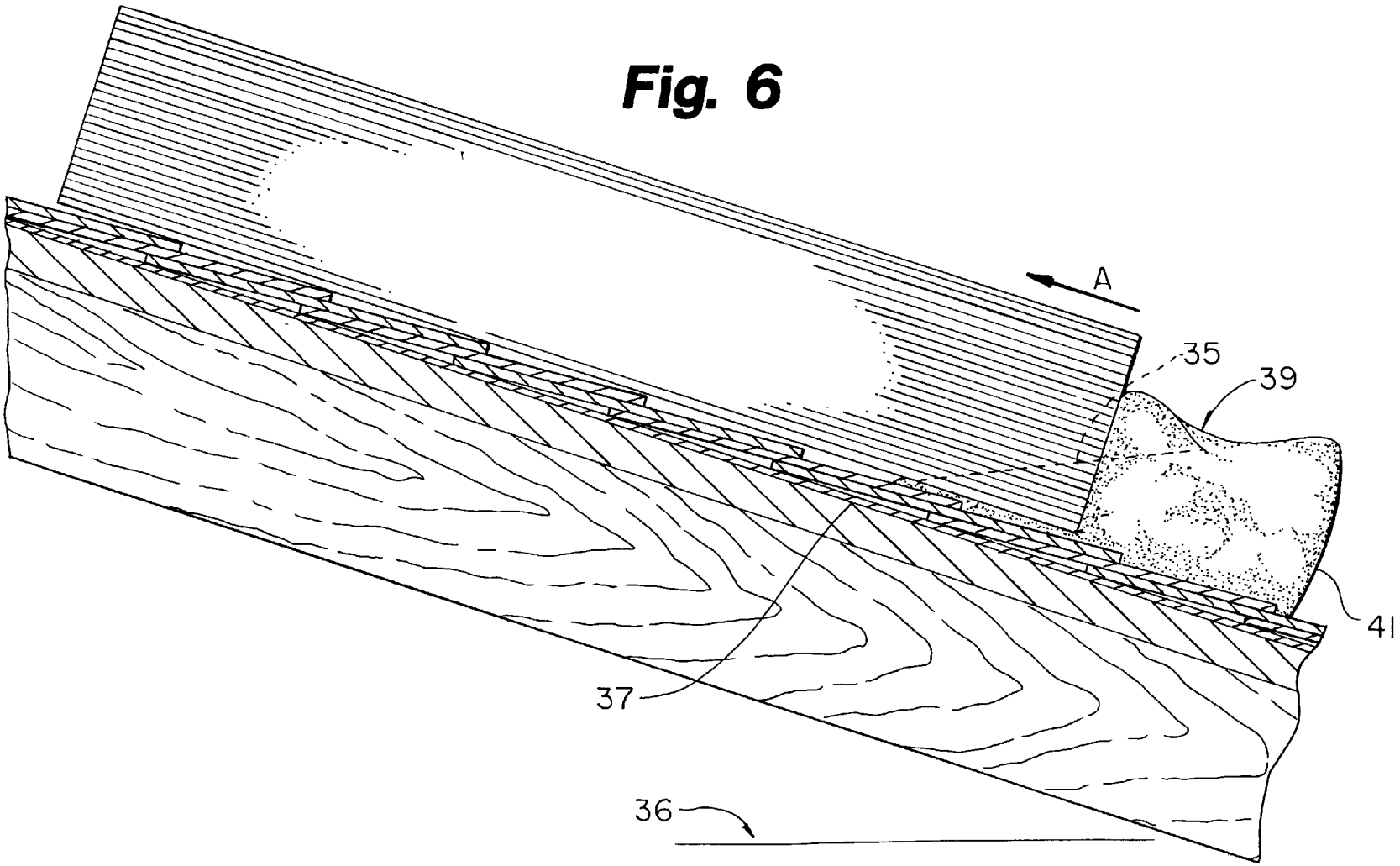
FIG. 6 is an enlarged fragmentary sectional elevational view taken on the line 6,6 of FIG. 5 showing a typical package of roofing shingles positioned on a shingled portion of a pitched roof and restrained from sliding by means of the foam rubber wedge portion of the apparatus of the present invention.

Referring now to FIGS. 1, 2 and 6, wedge 29 has a bottom surface 33 for placement against roof 27, and an upper surface 35 which is inclined relative to bottom surface 33. Bottom and upper surfaces 33, 35 meet to form a common forward edge 37 of wedge 29. As best seen in FIG. 6, the inclination of upper surface 35 at least partially counteracts the pitch of roof 27 when forward edge 37 is facing toward the peak (not shown) of roof 27. In this way, upper surface 35 is oriented more horizontally than the surface of roof 27, that is, upper surface 35 is less angled with respect to a horizontal reference plane 36. Upper surface 35 is shown in phantom lines in FIG. 6 prior to its resilient compression by the weight of shingles 25. Upper surface 35 in this embodiment is oriented at an angle of about 0° with respect to horizontal plane 36 when placed on a typical, residential roof. In other words, upper surface 35 is substantially horizontal and parallel to the plane 36 when wedge 29 is placed on the surface of roof 27.

Upper surface 35 resiliently compresses in response to placement of the shingles 25 thereon, as shown in the solid lines of FIG. 6. The resiliently compressed wedge 29 deforms into a retaining dam 39 against which shingles 25 are disposed.

Wedge 29 is preferably formed from an integral, substantially solid piece of foam rubber, but any resiliently compressible material which has a plastic memory is also suitable. As such, when wedge 29 is resiliently compressed as shown in FIG. 6 by the weight of shingles 25, the plastic memory generates a force generally in the direction indicated by arrow A, that is, toward the peak of roof 27 and against the shingles 25 or other roofing material which may be disposed on wedge 29.

The foam rubber which forms bottom surface 33 preferably is left substantially coarse or otherwise unfinished so that the bottom surface 33 readily generates friction when it is placed against pitched roof 27. The bottom surface 33, though preferably coarse, is also relatively planar and pliant so that it has a maximum amount of surface area available to frictionally engage roof 27. Upper surface 35 extends rearwardly from forward edge 37 to terminate in a rear edge 41. As such, wedge 29 has a height defined by the distance between bottom surface 33 and rear edge 41.

The wedge portion of apparatus 21 is used by roofer 23 as follows. Wedge 29, by being made substantially of foam rubber, is relatively lightweight and easily transported to the roof surface. The wedge 29 is then positioned with its tapered portion at forward edge 37 facing the peak (not shown) of pitched roof 27. As such, the upper surface 35 of wedge 29 is oriented substantially horizontally or, at a minimum, at an angle with horizontal plane 30 which is less than the pitch of the roof. The roofer then places shingles 25 or other planar roofing material at least partially against wedge 29 on upper surface 35 thereof. The weight of shingles 25 compresses wedge 29, deforming it until it forms the retaining dam 39 shown in FIG. 6, against which roofing materials 25 remain disposed. Deformation of wedge 29, in turn, generates a countervailing force against shingles 25 because of the plastic memory of the foam rubber. The countervailing force, the height of rear edge 41, the substantially horizontal orientation of upper surface 35, and the friction between the wedge 29 and roof 27 each contribute in varying degrees to keeping roofing material 25 substantially in position on the roof. In this way, roofer 23 is not faced with the possibility of roofing material 25 sliding off roof 27, and the roofer thus avoids the delay and potential damages if such a mishap were to occur.

Although variations in the dimensions and characteristics of wedge 29 are contemplated within the scope of the present invention, the height of rear edge 41 preferably ranges between about four inches and about six inches, and upper surface 35 is preferably inclined relative to bottom surface 33 at an angle α (FIGS. 1 and 2) which ranges between 10° and 15°. In one preferred embodiment, the height of rear edge 41 is selected so as to be between 50% and 75% of the height of a standard bundle of shingles 25 for residential roofs. Similarly, the wedge 29 functions suitably when upper surface 35 is oriented at an angle ranging from between 0° (aligned) to 30° with respect to horizontal plane 36 (FIG. 6). The resiliently compressible material is preferably selected so that upper surface 35 compresses by about four inches in response to receiving roofing material 25 weighing approximately 50 lbs. at a medial location 43 (FIG. 6).

Figure 3:
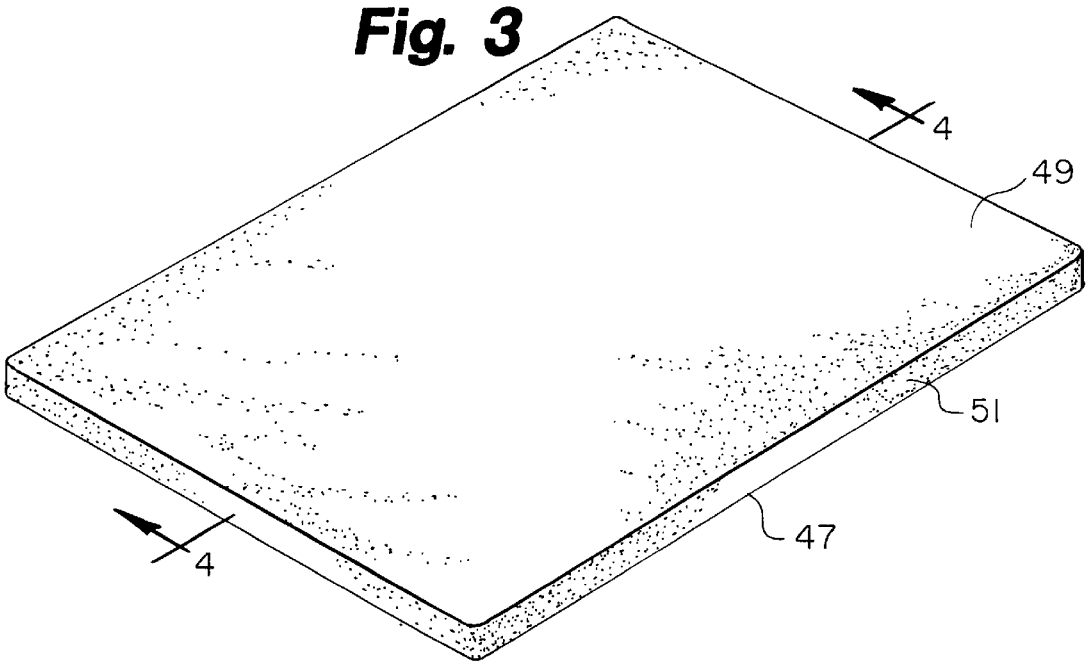
FIG. 3 is a perspective view showing a rectangular solid of foam rubber defining a pad according to the invention.
Figure 4:
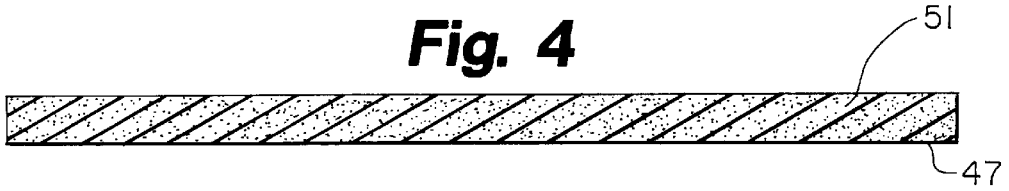
FIG. 4 is a slightly enlarged sectional elevational view taken on the line 4,4 of FIG. 3.

Substantially flat or planar member 31 comprises a second component of roofing apparatus 21. Referring to FIGS. 3, 4 and 5, member 31 is placed between roofer 33 and roof 23 and thereby defines a pad. Member or pad 31 is located at a first position designated 45 (FIG. 5), whereas wedge 29 is situated at a second position 47, spaced from first position 45 along the surface of roof 27, but preferably within reach of roofer 23 while he is situated on pad 31. Pad 31 has a lower planar surface 47 (FIGS. 3 and 4) for placement against roof 27, and an upper, kneeling surface 49 opposite lower surface 47. Lower surface 47 is sufficiently pliant to conform to the roof surface and thereby avoid damaging the surface of the shingles against which it is placed. Lower surface 47 is finished in such a way so that it readily generates friction when placed against the roof 27 to hold pad 31 in position.

Pad 31 includes thermal insulating means between the surfaces 47, 49. In this case, the thermal insulating means comprises foam rubber, and pad 31 is made entirely of a single, integral piece of foam rubber or similar, resiliently compressible material. The thermal insulating properties of the foam rubber keep the roofer from being made uncomfortable by the substantial heat which can be accumulated on the roof surface being worked on, especially during hot and sultry days. The foam rubber preferably comprises a selected thickness of material 51 which is located between upper and lower surfaces 47, 49.

Figure 7:
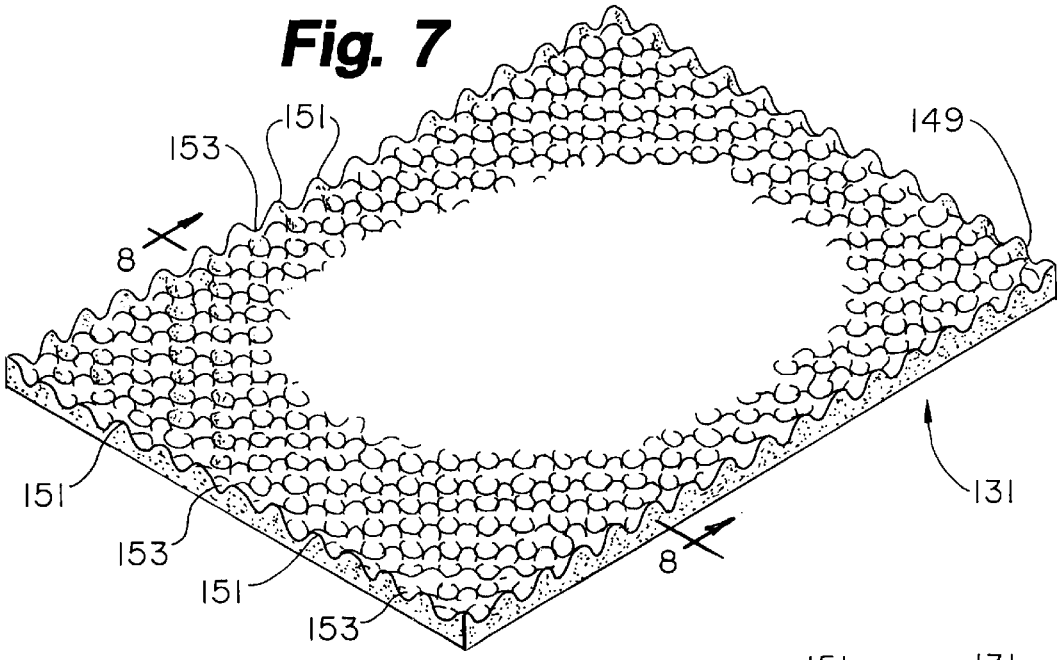
FIG. 7 is an isometric view similar to FIG. 3 but showing a modified form of pad, according to the present invention, having an undulating pattern of peaks and valley on its upper surface.
Figure 8:
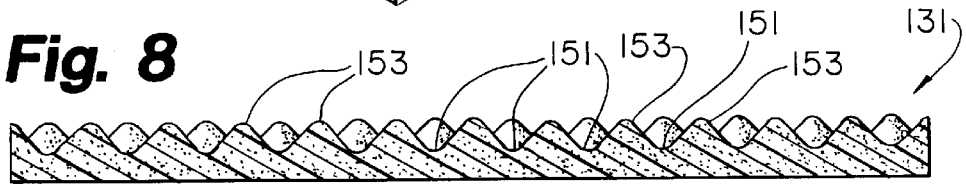
FIG. 8 is a slightly enlarged sectional elevational view taken on the line 8,8 of FIG. 7.
Figure 9:
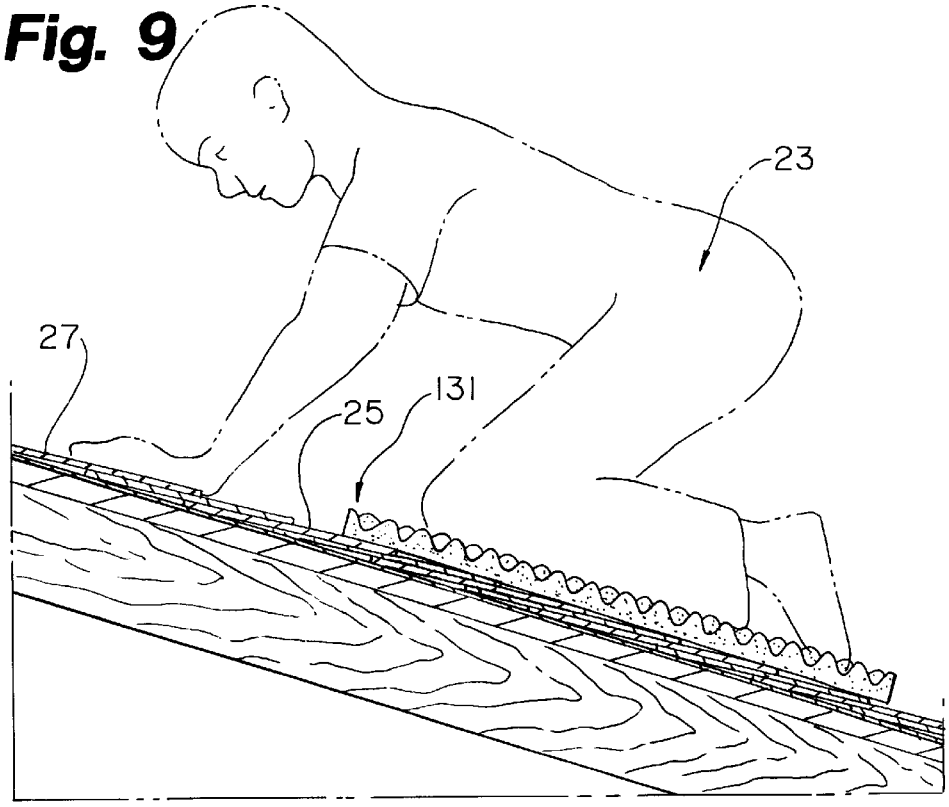
FIG. 9 is a fragmentary sectional elevational view taken on the line 9,9 of FIG. 5 showing a roofer, in dot and dash outline, kneeling on the modified pad shown in FIG. 7.

FIGS. 7–9 illustrate an alternative, substantially flat member 131. Member or pad 131 is substantially similar to the pad 31 discussed with reference to FIGS. 3–5, except that member 131 has been provided with a structure which dissipates into the ambient some of the heat absorbed by the foam rubber. In particular, upper kneeling surface 149 of flat member 131 has been formed into a plurality of peaks 151 and valleys 153. The pattern of peaks 151 and valleys 153 increases the area of kneeling surface 149 and thereby allows dissipation of accumulated heat more readily into the ambient, resulting in less heat being transferred from roof 27 to roofer 23.

In addition to the advantages apparent from the foregoing detailed description, the present invention is relatively lightweight, simple to manufacture, and simple to transport to jobs and onto pitched roofs for use.

As a further advantage, the apparatus is easy to use in that the wedge is simply placed with its tapered edge pointed to the peak of the roof, and roofing materials are placed thereon. Similarly, the thermally insulating pad is placed within reach of the roofing materials to be installed and the roofer situates him self on the pad. When the roofer needs to move to another work location on the roof, there is no need to unfasten either the wedge or the pad. Rather, the roofer simply picks up these components of the apparatus and relocates them to the desired position, where the roofing materials are again placed on the wedge and the roofer situates him self on the pad for further work.

The process can be repeated advantageously without needing to drive nails or other fasteners into the roof as a any point.

The apparatus has the advantage of being relatively compact and, in fact, can be compressed for limited periods of time during transport if space is at a premium.

Figure 10:
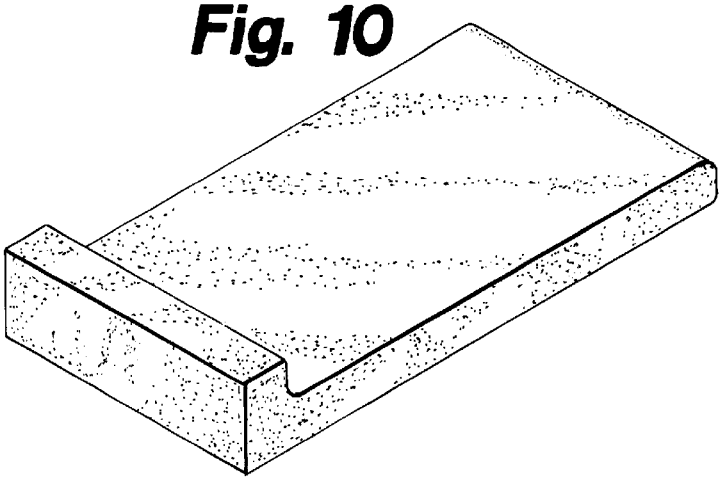
FIG. 10 is an isometric view of a modified retaining dam for a package of roofing shingles resting on a roof.
Figure 11:
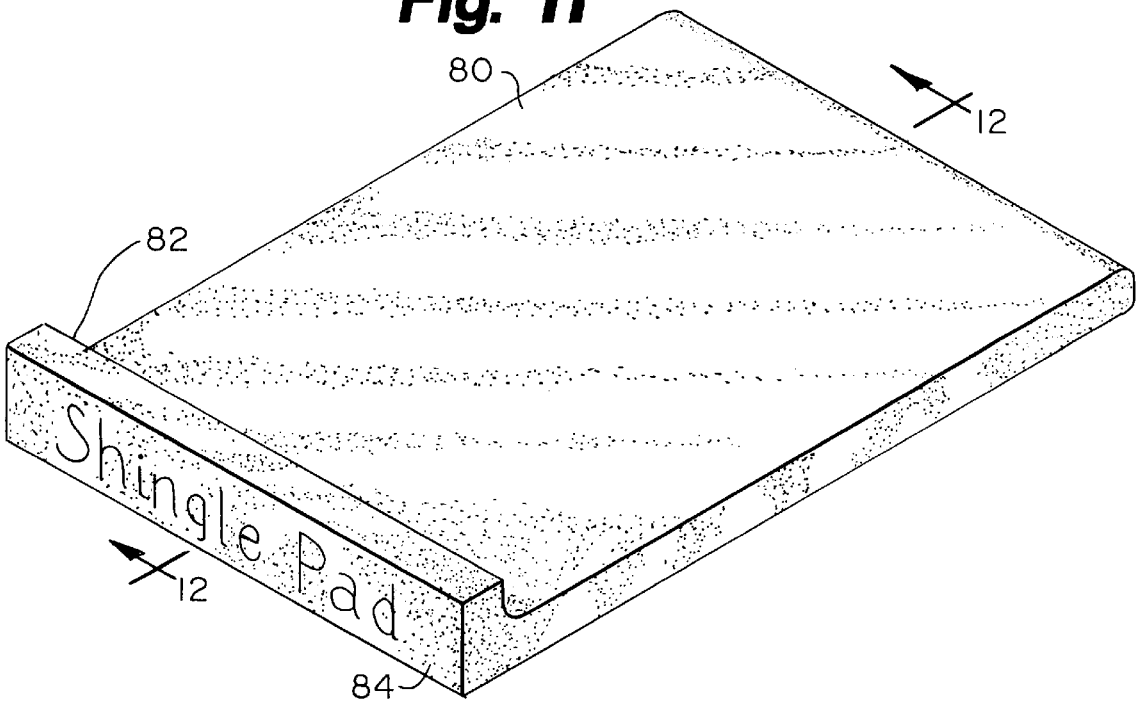
FIG. 11 is an isometric view of an additional modified kneeling pad.
Figure 12:
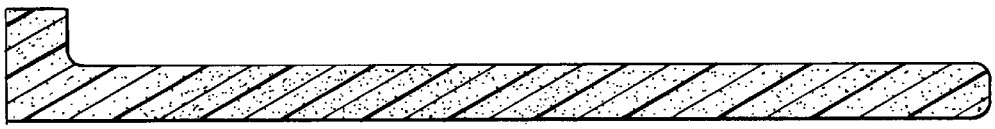
FIG. 12 is a slightly enlarged sectional elevational view taken on the line 12, 12, of FIG. 11.

There is shown in FIGS. 10–12, inclusively another embodiment of shingle pad in accordance with the present invention. The embodiment of the invention is characterized by novel features of construction and arrangement providing certain functional advantages. For example, the shingle pad of the present invention reduces scarfing and scuffing of new roofs and insulates the worker or roofer against excessive roof heat. The shingle pad provides improved traction and in general increases productivity of the workers utilizing the shingle pad in accordance with the present invention. It has been found that the use of the shingle pad eliminates tool dropping and sliding and reduces back pain and fatigue. It is noted, however, that the shingle pad is intended primarily for improving user comfort and is not intended as a safety product. In this regard, the shingle pad of the present invention is intended primarily for use on asphalt shingles and is to be used on roofs which less than a 4/12 roof pitch.

The shingle pad of the present invention comprises, as best illustrated in FIG. 11 an elongated, generally rectangular base 80 of the length having a shelf 82 projecting transversely from the base along the bottom edge 84 thereof. The shingle pad is preferably made of a resiliently, compressible foam material. The bottom of the base is planar or flat and provides a large surface area which directly seats or bears on the shingles to support a worker in the manner illustrated in FIG. 9. It has been found an effective kneeling pad size is one wherein the bases has a width of approximately 24 inches and a length of approximately 36 inches and, wherein the thickness of the base is approximately 2 inches and the height H of the shelf is approximately 4 inches. The face of the bottom edge 84 of the shelf 82 presents a large area for advertizing the meeting shingles used as well as providing a toe stop for the roofers shoes. It has been found that a shingle pad of slightly smaller length and width is suitable for stacking shingles to be applied to the roof in the manner shown in FIG. 10.

It will be appreciated that variations to the preferred embodiment can be contemplated by those skilled in the art, and that such variations are within the scope of the present invention, as are other variations that skill or fancy may suggest. The foregoing description of preferred embodiments being for illustration only, the invention is defined by the scope of the appended claims that follow.

What is claimed:

1. A method of assisting roofers in applying roofing material, shingles, to a pitched roof, comprising the steps of:

(a) positioning a one-piece pad made entirely of a resilient, compressible foam material having planar pliable upper surface and lower surface defining a friction face and a shelf projecting transversely from one edge of the base of uniform height and width for the entire width of the base; and (b) placing shingles to be installed directly on the foam upper surface, thereby generating a force against the roofing materials directed toward the peak of the roof by means of a plastic memory of the resiliently compressible material, the pliable bottom surface and the force keeping the roofing material on the pitched roof.

* * * * *